US007588088B2

(12) United States Patent
Zachman

(10) Patent No.: US 7,588,088 B2
(45) Date of Patent: Sep. 15, 2009

(54) MOTOR GRADER AND CONTROL SYSTEM THEREFORE

(75) Inventor: Mark Zachman, Troy, OH (US)

(73) Assignee: Catgerpillar Trimble Control Technologies, LLC, Dayton, OH (US)

( * ) Notice: Subject to any disclaimer, the term of this patent is extended or adjusted under 35 U.S.C. 154(b) by 336 days.

(21) Appl. No.: 11/451,721

(22) Filed: Jun. 13, 2006

(65) Prior Publication Data

US 2008/0000659 A1 Jan. 3, 2008

(51) Int. Cl.
*E02F 3/76* (2006.01)

(52) U.S. Cl. ..... 172/4.5; 172/799; 172/818; 701/50

(58) Field of Classification Search ..... 172/2, 172/4, 4.5, 779, 818–821; 701/50
See application file for complete search history.

(56) References Cited

U.S. PATENT DOCUMENTS

| | | | | |
|---|---|---|---|---|
| 3,786,871 | A | 1/1974 | Long et al. | |
| 4,156,466 | A * | 5/1979 | Caldwell | 172/4.5 |
| 4,473,090 | A * | 9/1984 | Uehara et al. | 137/114 |
| 4,926,948 | A | 5/1990 | Davidson et al. | |
| 4,945,221 | A * | 7/1990 | Nielsen et al. | 250/203.1 |
| 5,107,932 | A | 4/1992 | Zachman et al. | |
| 5,845,302 | A | 12/1998 | Cyman, Jr. et al. | |
| 5,951,612 | A * | 9/1999 | Sahm | 701/50 |
| 6,028,524 | A | 2/2000 | Hartman et al. | |
| 6,062,317 | A * | 5/2000 | Gharsalli et al. | 172/2 |
| 6,112,145 | A | 8/2000 | Zachman | |
| 6,269,885 | B1 * | 8/2001 | Barber et al. | 172/7 |
| 6,286,606 | B1 | 9/2001 | Krieg et al. | |
| 6,295,746 | B1 * | 10/2001 | Meduna et al. | 37/382 |
| 6,389,345 | B2 * | 5/2002 | Phelps | 701/50 |
| 2006/0042838 | A1 * | 3/2006 | Yeoman et al. | 180/6.2 |
| 2007/0235201 | A1 * | 10/2007 | Gharsalli | 172/4.5 |

* cited by examiner

*Primary Examiner*—Thomas B Will
*Assistant Examiner*—Matthew D Troutman
(74) *Attorney, Agent, or Firm*—Dinsmore & Shohl LLP

(57) ABSTRACT

A motor grader has a control system in which the manner of controlling the blade position differs depending upon whether the blade is to be moved vertically or is to be maintained at a generally constant level and cross slope. First and second hydraulic valves control the flow of hydraulic fluid to the first and second hydraulic cylinders which raise and lower respective ends of the blade. An inclinometer provides an inclinometer output indicating the inclination of the blade along its length with respect to horizontal. The control system includes a first hydraulic cylinder position sensor for determining the extension of the first hydraulic cylinder. The control system further includes a control that is responsive to a control input specifying the desired height and cross slope of the blade, to the first hydraulic cylinder position sensor, and to the inclinometer output. The control provides valve control signals to the first and second hydraulic valves. The control provides a first valve control signal to the first hydraulic valve in dependence upon a desired height specified by the control input, and the control provides a second valve control signal to the second hydraulic valve in dependence upon the inclinometer output and upon the cross slope specified by the control input. However, when the blade is to be moved upward or downward with the retraction or extension of the first cylinder, the control provides the second valve control signal to the second hydraulic valve in dependence upon the first hydraulic cylinder position sensor such that the second hydraulic cylinder retracts and extends with the first hydraulic cylinder, maintaining the cross slope angle of the blade as a constant.

13 Claims, 3 Drawing Sheets

MOTOR GRADER AND CONTROL SYSTEM THEREFORE

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates generally to a motor grader and a control system for a motor grader of the type in which the vertical position of the grader blade is controlled by a pair of hydraulic cylinders. More particularly, the present invention relates to such a motor grader and control system in which the extension or retraction of one hydraulic cylinder of the pair follows that of the other hydraulic cylinder when vertical movement of the blade is to be effected, thereby maintaining the cross slope angle.

Motor graders are used to alter the contours of construction sites and road beds. Motor graders typically include a work implement, such as a surface-altering blade, that is movably connected to a frame of the grader by a structure including a pair of independently controlled hydraulic cylinders. The hydraulic cylinders are mounted on either side of the machine frame of the motor grader. The hydraulic cylinders are operated independently, and can be extended or retracted to lower or raise the respective ends of the blade relative to the corresponding sides of the machine frame. The blade height may be controlled manually or automatically.

In the manual mode, the operator controls the vertical position of one or both ends of the blade through a pair of control levers mounted in the cab of the motor grader. Each control lever modulates a corresponding control valve that is mechanically linked or electrically linked to the control lever. The manual control valves are connected between an hydraulic fluid supply and the hydraulic cylinders. The operator actuates the manual control valves to achieve the desired elevational position of the blade at one or both ends of the blade. In one variation of manual control, an inclinometer mounted for movement with the blade, provides an inclinometer output indicating the inclination of the blade along its length. The operator sets the desired inclination in the control system. The control system compares the measured inclination with the desired inclination and controls one control valve to extend or retract its associated cylinder at the same time that other cylinder is extended or retracted. This is accomplished while maintaining the slope of the blade at a desired inclination.

In the automatic mode, raising and lowering the blade by retracting and extending the cylinders is controlled based on the difference between desired blade height and measured blade height. The blade height may be measured in any of a number of ways, including the use of GPS-based and laser-based systems. The height of each end of the blade may be measured in this mode of operation. Alternatively, the height of one end of the blade may be measured, and the hydraulic cylinder at that end of the blade operated, based on the difference between the measured and desired height. The hydraulic cylinder at the other end of the blade is actuated based on the difference between the desired and measured inclination of the blade along its length. An inclinometer on or mechanically linked to the blade provides the measurement of blade inclination in this mode, as well.

Inclinometers are typically mechanically or electrically damped to reduce the rapid fluctuations and signal noise in the output that would otherwise result from vibration in the mechanical systems. However, damping produces a time delay in an inclinometer output in a motor grader system that degrades the operation of the system when a change in the elevation of the blade is to be effected. Because the hydraulic cylinder that is controlled manually or automatically is extended or retracted quickly in such a situation, the inherent time delay in the inclinometer results in one end of the blade being lowered or raised by a significant amount before the inclinometer provides an output indicating a change in inclination. This, in turn, results in an erroneous cross slope cut during those times when elevational change is effected.

It is seen, therefore, that there is a need for a motor grader, and control system for a motor grader, capable of changing the vertical blade position without introducing errors in the cross slope orientation of the motor grader blade.

SUMMARY OF THE INVENTION

This need is met by a motor grader and a control system for the motor grader in which the manner of controlling the blade position is different when the blade is moved upward or downward than when the blade is maintained at a desired height and inclination. The motor grader has a blade for grading a surface, and first and second hydraulic cylinders for raising and lowering the blade adjacent its first and second ends. First and second hydraulic valves control the flow of hydraulic fluid to the first and second hydraulic cylinders, respectively. An inclinometer is mounted for movement with the blade to provide an inclinometer output indicating the inclination of the blade along its length with respect to horizontal. The control system includes a first hydraulic cylinder position sensor for determining the extended position of the first hydraulic cylinder. The control system further includes a control that is responsive to a control input specifying the desired height and cross slope of the blade, to the hydraulic cylinder position sensor, and to the inclinometer output. The control provides valve control signals to the first and second hydraulic valves. The control provides a first valve control signal to the first hydraulic valve in dependence upon a desired height specified by the control input, and the control provides a second valve control signal to the second hydraulic valve in dependence upon the inclinometer output and upon the cross slope specified by the control input. However, when the blade is to be moved upward or downward, the control provides the second valve control signal to the second hydraulic valve in dependence upon the hydraulic cylinder position sensor such that the second hydraulic cylinder extends and retracts with the first hydraulic cylinder in a way that maintains the cross slope angle of the blade. When the second hydraulic cylinder is controlled in a closed loop manner, the control provides the second valve control signal to said second hydraulic valve in dependence upon the first and the second hydraulic cylinder position sensors.

The control provides the second valve control signal to the second hydraulic valve in dependence upon the hydraulic cylinder position sensor when the difference between the desired height and the measured height of the blade exceeds a predetermined threshold level. The control system further includes a manual control mechanism to permit the operator to control the control input manually, specifying the desired height and cross slope of the blade. The control system further includes an automated system that provides control signals to the valves in dependence upon the location of the motor grader.

A method of controlling a motor grader of this type comprises the steps of determining the inclination of the blade, raising or lowering the first end of the blade with a first hydraulic cylinder in response to a control input applied to a controller, and raising or lowering the second end of the blade. When the blade is to be maintained at a desired height, the inclination of the blade is monitored and the second end of the blade is raised or lowered with the second hydraulic cylinder so that the measured inclination of the blade remains constant. When the blade is to be moved upward or downward, however, the position of the first hydraulic cylinder is monitored and the second end of the blade is raised or lowered with the second hydraulic cylinder such that the second hydraulic cylinder moves with the movement of the first hydraulic cylinder. The second hydraulic cylinder may be controlled in either an open loop or a closed loop fashion.

The method further includes the step of monitoring the position of the first hydraulic cylinder with a sensor that monitors extension and retraction of the cylinder. The method further includes the step of monitoring the position of the second hydraulic cylinder with a sensor that monitors extension and retraction of the cylinder. The method may include the step of providing a control input to the control from a manually actuated control device. Alternatively, the method may include the step of providing a control input to the control from an automated system. The step of providing a control input to the control from an automated system may include the steps of projecting a reference plane of laser light, and a receiving the plane of laser light with a receiver, carried on the motor grader. The step of providing a control input to the control from an automated system may include the step of determining the position of the motor grader and determining the desired height of the first end of the blade and the desired inclination of the blade at the position of the motor grader.

It is an object of the present invention to provide a motor grader and a control for a motor grader that is capable of raising and lowering the grader blade with desired precision. Other objects and advantages of the invention will be apparent from the following description, the accompanying drawings, and the appended claims.

DETAILED DESCRIPTION OF THE PREFERRED EMBODIMENT

Figure 1:
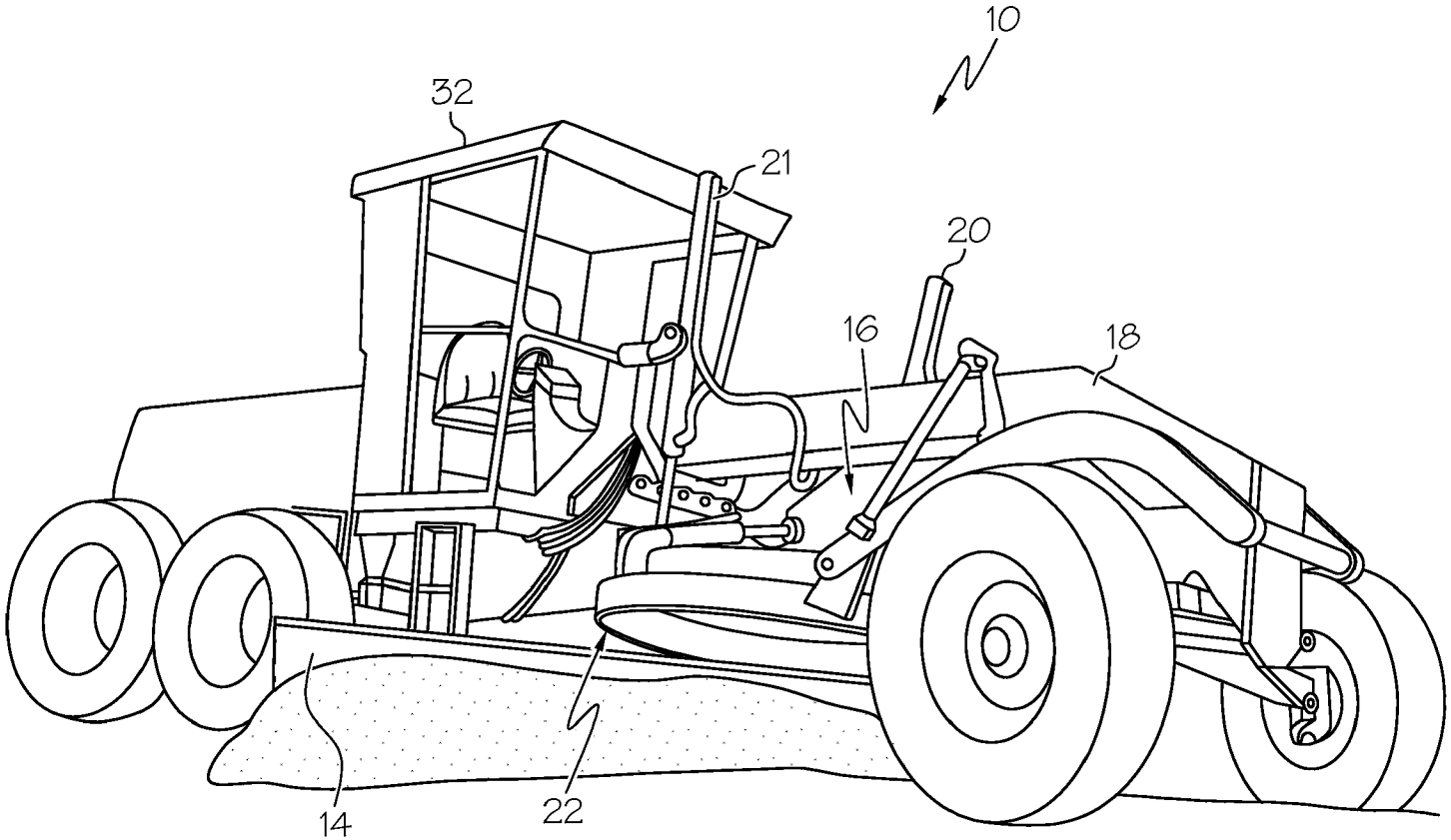
FIG. 1 is a perspective view of a motor grader, including a control system, constructed according to the present invention.
Figure 2:
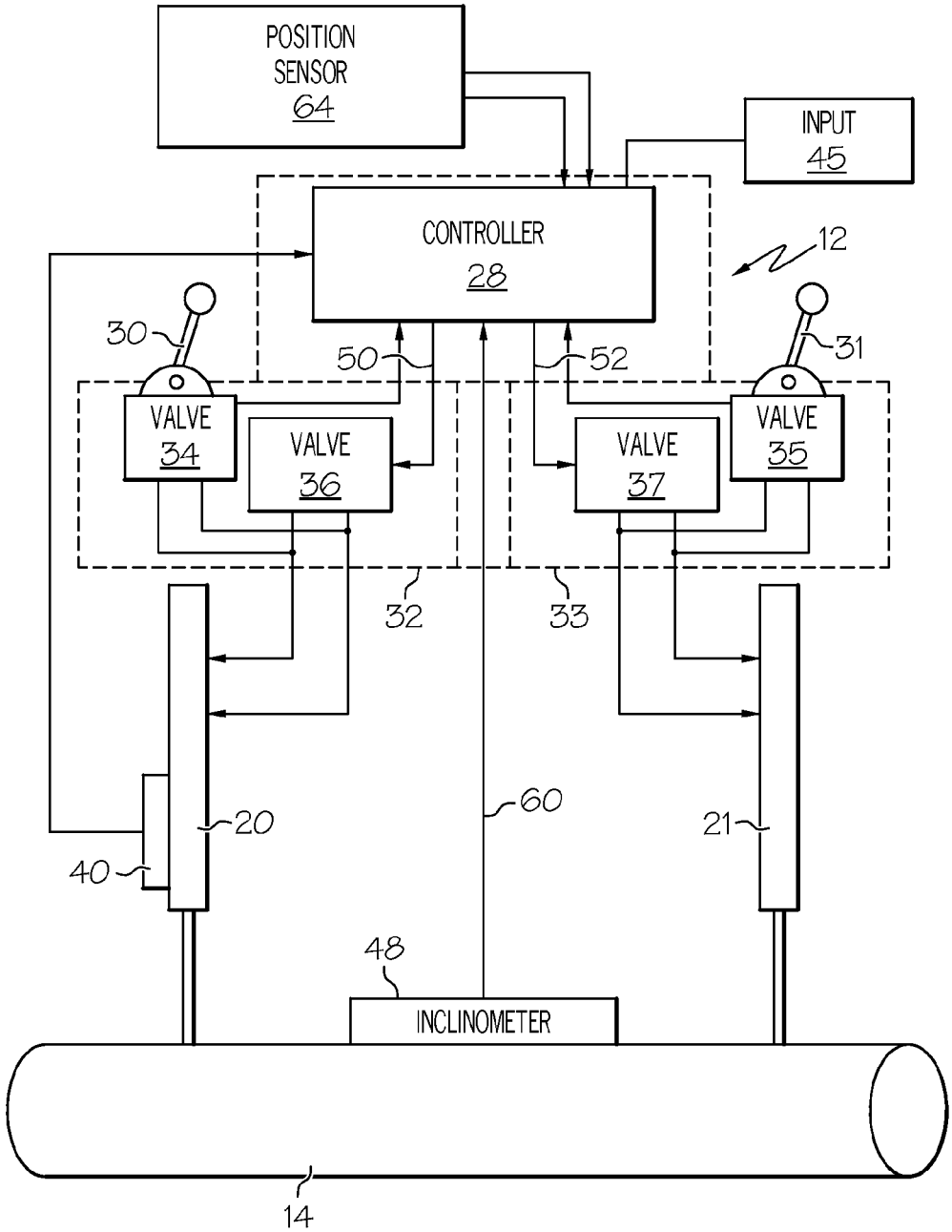
FIG. 2 is a diagram showing a first embodiment of a control system for a motor grader, constructed according to the present invention.

Reference is made to FIGS. 1 and 2 of the drawings which illustrate the invention. The motor grader 10 includes a control system 12, shown in FIG. 2, for controlling the height of conventional grader blade 14. Blade 14 is part of a blade sub-assembly, indicated generally at 16, that is movably mounted to a frame 18 of the motor grader 10 through first and second individually controllable hydraulic motors or lift cylinders 20 and 21 that are connected between the machine frame 18 and the blade sub-assembly 16. The blade sub-assembly 16 includes a circle and circle draw bar, indicated generally at 22, and a grader blade 14 mounted to the circle. A selectively controllable circle drive (not shown) is mounted to the circle draw bar for rotating the circle and the blade about a generally vertical axis in a known manner. While the blade control system 12 will be described in detail below as applied to the motor grader of FIG. 1, it will be appreciated by those skilled in the art that other machines, such as bulldozers, compactors, pavers, profilers, scrapers and the like, equipped with suitable surface altering implements, are to be considered controllable by the control system, and are contemplated within the scope of the present invention.

With reference to FIG. 2, the control system 12 controls the orientation of the grader blade 14 of motor grader 10. During operation of the motor grader 10, the grade and cross-slope positions of blade 14 may be set and adjusted by manual or automatic control of the extension and retraction of the hydraulic cylinders 20 and 21 which are connected to the blade sub-assembly 16. The pair of hydraulic lift cylinders 20 and 21 may be retracted and extended to raise and lower the corresponding ends of the blade 14 relative to the frame 18.

In the manual control mode, the operator controls the vertical position of one or both ends of the blade 14 through a pair of manually actuatable control levers 30 and 31, located in cab 32 of the motor grader 10. Manually actuatable control lever 30 is connected to a first valve 32 including a manually actuatable control valve 34 unit and an electrically actuatable control valve 36. Manually actuatable control lever 31 is connected to a second valve 33 including a manually actuatable control valve 35 and electrically actuatable control valve 37. The control valves 34, 35, 36 and 37 are each connected between a hydraulic fluid supply (not shown), and a corresponding respective one of the hydraulic lift cylinders 20 and 21. Movement of control levers 30 and 31 allows hydraulic fluid to flow under pressure through the manual control valves 34 and 35 to actuate the hydraulic lift cylinders 20 and 21, extending or retracting the cylinders, depending upon the direction in which the control levers are moved.

Electrically actuatable or automatic control valves 36 and 37 are each connected between the hydraulic fluid supply (not shown) and a respective one of the hydraulic lift cylinders 20 and 21 to control extension and retraction of the corresponding hydraulic lift cylinders 20 and 21 in response to signals on lines 50 and 52. The automatic control valves 36 and 37 are electrically coupled to the controller 28. Controller 28 provides command signals to adjust the elevational position of corresponding blade ends through actuation of respective hydraulic lift cylinders 20 and 21. The automatic control valves 36 and 37 are connected in parallel with the manual control valves 34 and 35, respectively, and are operable independently from the manual control valves 34 and 35, as described below.

The control system further includes a first hydraulic cylinder position sensor 40 for determining the extended position of the first hydraulic cylinder 20 and providing this information to the controller 28. The sensor may be any of a number of known sensors that are suitable for this purpose. The controller 28 is responsive to a control input 45 that specifies the desired height and cross slope of the blade 14. The controller 28 is responsive to control input 45 specifying the desired height, to the hydraulic cylinder position sensor 40, and to the inclinometer 48, for providing valve control signals to the first and second hydraulic valves 36 and 37. In one automatic mode, the controller 28 provides a first valve control signal on line 50 to the first hydraulic valve 36 in dependence upon desired height specified by the control input 45, and the control 28 provides a second valve control signal on line 52 to the second hydraulic valve 37 in dependence upon the inclinometer output on line 60 and upon the cross slope specified by the control input 45.

A difficulty encountered with this arrangement occurs when the control input on line 50 calls for movement of cylinder 20, or when the valve 36 is actuated in such a way as to call for movement of cylinder 20. If the inclinometer output were to be used to determine the control signal on line 52, no corresponding change in the extension or retraction of the cylinder 21 would be effected quickly, resulting in the blade 14 being inaccurately oriented. The present invention eliminates this problem by using the hydraulic cylinder position sensor 40. During times when the blade 14 is to be moved upward or downward, the control 28 provides the second valve control signal 52 to the second hydraulic valve 37 in dependence upon the hydraulic cylinder position sensor 40 which determines the extended position of the first hydraulic cylinder 20, such that the second hydraulic cylinder 21 extends and retracts in a manner corresponding to the extension and retraction of the first hydraulic cylinder 20. The amount of extension or retraction of the hydraulic cylinder is a function of the geometry of the cylinders and blade support components and linkages, but is effected in such a way as to keep the cross slope angle cut by the blade 14 constant. It will be appreciated that this will eliminate the inaccuracies that have resulted from inclinometer damping and the resulting signal delay.

Figure 3:
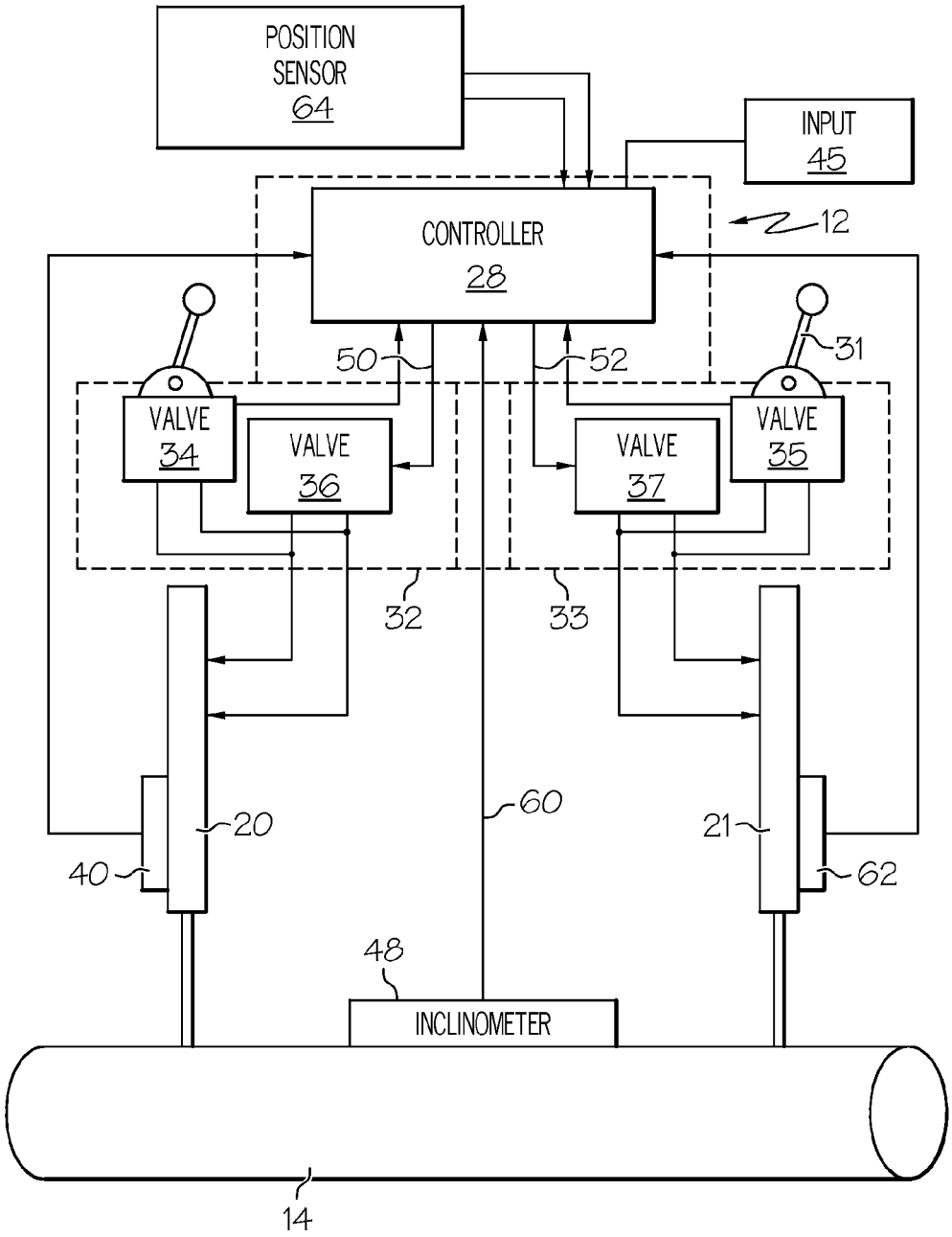
FIG. 3 is a diagram showing a second embodiment of a control system for a motor grader, constructed according to the present invention.

It will be appreciated that it may be desired that the second cylinder 21 be controlled in a closed loop manner, rather than being driven open loop. A control system using such closed loop control is shown in FIG. 3. In FIG. 3, elements which correspond to those shown in FIG. 2 are designated by the same reference numerals. In the system of FIG. 3, the inaccuracies that might result from actuating valve 37 in an open loop drive are eliminated by the addition of hydraulic cylinder position sensor 62 to the hydraulic cylinder 21, providing an indication to the controller 28 of the amount of extension of cylinder 21. This permits closed loop control of cylinder 21 so that extension and retraction are measured, and are caused to track precisely the desired extension and retraction.

With reference to FIG. 3, the control system 12 controls the orientation of the grader blade 14 of motor grader 10. During operation of the motor grader 10, the grade and cross-slope positions of blade 14 may be controlled by manual or automatic extension and retraction of the hydraulic lift cylinders 20 and 21 connected to the blade sub-assembly 16. The pair of hydraulic lift cylinders 20 and 21 may be retracted and extended to raise and lower the corresponding sides of the blade 14 relative to the frame 18.

In the manual control mode, the operator can control the vertical position of one or both ends of the blade 14 through the pair of manually actuatable control levers 30 and 31, which are connected to valves 34 and 35, respectively. The automatic control valves 36 and 37 are electrically coupled to the controller 28. Controller 28 provides command signals to adjust the elevational position of a corresponding blade side through actuation of a respective hydraulic lift cylinder 20 and 21.

As with the previous embodiment, the control system includes a hydraulic cylinder position sensor 40 for determining the extended position of the first hydraulic cylinder 21 and providing this information to the controller 28. The controller 28 is responsive to a control input 45 that specifies the desired height and cross slope of the blade 14. The control 28 is responsive to control input 45 specifying the desired height, to the hydraulic cylinder position sensor 40, and to the inclinometer 48, for providing valve control signals to the first and second hydraulic valves 36 and 37. In one automatic mode of operation, during periods when the grader blade 14 is to be maintained a constant height and inclination, the control 28 provides a first valve control signal on line 50 to the first hydraulic valve 36 in dependence upon desired height specified by the control input 45, and the control 28 provides a second valve control signal on line 52 to the second hydraulic valve 37 in dependence upon the inclinometer output on line 60 and upon the cross slope specified by the control input 45.

When the valve 34 or the valve 36 is actuated to call for movement of cylinder 20, the inclinometer output is not used to determine the control signal on line 52. Rather, the control 28 provides the second valve control signal 52 to the second hydraulic valve 37 in dependence upon the hydraulic cylinder position sensor 40 which determines the extended position of the first hydraulic cylinder 20 and in dependence upon the hydraulic cylinder position sensor 62 and the geometry of the cylinders 20 and 21 and cylinder linkage, such that the second hydraulic cylinder 21 extends and retracts with the first hydraulic cylinder 20 in a manner that keeps the cross slope cut of the blade 14 at a constant angle. It will be appreciated that this will eliminate the inaccuracies that might have resulted from the valve 37 being driven in an open loop fashion.

The control system includes an automated system for controlling the control input to provide valve control signals to the valves in dependence upon the location of the motor grader, which may include a laser or GPS based blade position sensor 64. The system determines the x and y position of the motor grader blade as the motor grader moves across the construction site or along the road bed. The vertical position of the blade is then determined by either GPS or laser measurement and compared with the desired vertical position. The blade is then raised or lowered to bring this difference to null and the blade is tilted to the desired position by relative movement of the cylinders 20 and 21 and measurement of the inclination of blade 14 with inclinometer 48 with respect to horizontal. When the blade is to be raised or lowered, the cylinder 21 is driven in dependence upon the movement of the cylinder 20 without reference to the inclinometer output until a new steady state operating position is achieved. At this point the output of the inclinometer 48 is again to control the extension of cylinder 21.

Other aspects, objects and advantages of the present invention can be obtained from a study of the drawings, the disclosure and the appended claims.

What is claimed is:

1. A control system for a motor grader of the type having a blade for grading a surface, said motor grader further having first and second hydraulic cylinders for raising and lowering said blade adjacent first and second ends thereof, first and second hydraulic valves for controlling the flow of hydraulic fluid to said first and second hydraulic cylinders, respectively, and an inclinometer mounted for movement with said blade to provide an inclinometer output indicating the inclination with respect to horizontal of said blade along its length, comprising:

a first hydraulic cylinder position sensor for determining the extended position of said first hydraulic cylinder, and a control, responsive to a control input specifying the desired height and cross slope of the blade, to said hydraulic cylinder position sensor, and to said inclinometer output, for providing valve control signals to said first and second hydraulic valves, wherein said control provides a first valve control signal to said first hydraulic valve in dependence upon said desired height specified by said control input, and said control provides a second valve control signal to said second hydraulic valve in dependence upon said inclinometer output and upon the cross slope specified by said control input, and wherein, during times when said blade is to be moved upward or downward, and said first hydraulic cylinder extended or retracted, said control provides said second valve control signal to said second hydraulic valve in dependence upon said first hydraulic cylinder position sensor which determines the extended position of said first hydraulic cylinder, such that said second hydraulic cylinder extends and retracts with said first hydraulic cylinder.

2. The control system for a motor grader according to claim 1, in which said control provides said second valve control signal to said second hydraulic valve in dependence upon said first hydraulic cylinder position sensor when the difference between said desired height and said measured height of said blade is sufficient to cause actuation of said first hydraulic valve and extension or retraction of said first hydraulic cylinder.

3. The control system for a motor grader according to claim 1, further comprising a manual control mechanism to permit the operator to control the control input manually, specifying the desired height and cross slope of the blade.

4. The control system for a motor grader according to claim 1, further comprising an automated system for controlling the control input to provide valve control signals to said valves in dependence upon the location of said motor grader.

5. A motor grader comprising:

a blade for grading a surface, a motor grader body, first and second hydraulic cylinders for raising and lowering first and second ends of said blade with respect to said body, first and second hydraulic valves for controlling the flow of hydraulic fluid to said first and second hydraulic cylinders, respectively, an inclinometer mounted for movement with said blade to provide an inclinometer output indicating the inclination with respect to horizontal of said blade along its length, and a control system including a first hydraulic cylinder position sensor for determining the extended position of said first hydraulic cylinder, and a control, responsive to a control input specifying the desired height and cross slope of the blade, responsive to said first hydraulic cylinder position sensor, and responsive to said inclinometer output, for providing valve control signals to said first and second hydraulic valves, a first valve control signal to said first hydraulic valve being provided in dependence upon a desired height specified by said control input, and a second valve control signal to said second hydraulic valve being provided in dependence upon said inclinometer output and upon the cross slope specified by said control input, wherein, during times when said blade is to be moved upward or downward, said control provides said second valve control signal to said second hydraulic valve in dependence upon said first hydraulic cylinder position sensor, such that said second hydraulic cylinder extends and retracts with said first hydraulic cylinder.

6. The motor grader of claim 5, in which said control provides said second valve control signal to said second hydraulic valve in dependence upon said first hydraulic cylinder position sensor when the difference between said desired height and said measured height of said blade is sufficient to cause actuation of said first hydraulic valve and extension or retraction of said first hydraulic cylinder.

7. The motor grader of claim 5, further comprising a manual control mechanism to permit the operator to control the control input manually, specifying the desired height and cross slope of the blade.

8. The motor grader of claim 5, further comprising an automated system for controlling the control input to provide valve control signals to said valves in dependence upon the location of said motor grader.

9. A method of controlling a motor grader, said motor grader having a blade for grading a surface, having first and second hydraulic cylinders for raising and lowering said blade adjacent first and second ends thereof, having first and second hydraulic valves for controlling the flow of hydraulic fluid to said first and second hydraulic cylinders, respectively, and having an inclinometer mounted for movement with said blade to provide an inclinometer output indicating the inclination with respect to horizontal, comprising the steps of:

determining the inclination of said blade, raising or lowering the first end of the blade with said first hydraulic cylinder in response to a control input applied to a control, monitoring the inclination of the blade with said inclinometer and raising or lowering the second end of the blade with said second hydraulic cylinder so that the measured inclination of the blade remains constant when said blade is not to be raised or lowered significantly, and when said blade is to be raised or lowered significantly by extension or retraction of the first hydraulic cylinder, monitoring the position of said first hydraulic cylinder with a first sensor that monitors extension and retraction of said first hydraulic cylinder and raising or lowering the second end of the blade with said second hydraulic cylinder such that the second hydraulic cylinder moves with said first hydraulic cylinder.

10. A method of controlling a motor grader according to claim 9 further including the step of providing a control input to said control from a manually actuated control device.

11. A method of controlling a motor grader according to claim 9 further including the step of providing a control input to said control from an automated system.

12. A method of controlling a motor grader according to claim 11 in which said step of providing a control input to said control from an automated system includes the steps of projecting a reference plane of laser light and a receiving the plane of laser light with a receiver, carried on said motor grader.

13. A method of controlling a motor grader according to claim 12 in which said step of providing a control input to said control from an automated system includes the step of determining the position of the motor grader and determining the desired height of the first end of the blade and the desired inclination of the blade at the current position of the motor grader.

* * * * *

UNITED STATES PATENT AND TRADEMARK OFFICE

CERTIFICATE OF CORRECTION

PATENT NO. : 7,588,088 B2
APPLICATION NO. : 11/451721
DATED : September 15, 2009
INVENTOR(S) : Mark Zachman It is certified that error appears in the above-identified patent and that said Letters Patent is hereby corrected as shown below:

(73) Assignee: "Categerpillar Trimble Control Technologies, LLC, Dayton OH (US)" should read --Caterpillar Trimble Control Technologies, LLC, Dayton OH (US)--; and Col. 3, Line 32 "and a receiving the plane of laser" should read --and receiving the plane of laser--.

Signed and Sealed this

Second Day of February, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,588,088 B2
APPLICATION NO. : 11/451721
DATED : September 15, 2009
INVENTOR(S) : Mark Zachman It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 430 days.

Signed and Sealed this

Twenty-first Day of September, 2010

David J. Kappos

David J. Kappos
*Director of the United States Patent and Trademark Office*